US005153500A

United States Patent [19]

Yamamoto et al.

[11] Patent Number: 5,153,500

[45] Date of Patent: Oct. 6, 1992

[54] CONSTANT-VOLTAGE GENERATION CIRCUIT

[75] Inventors: Kazushige Yamamoto; Hiroyuki Tokutomi, both of Tokyo, Japan

[73] Assignee: Oki Electric Industry Co., Ltd., Japan

[21] Appl. No.: 746,913

[22] Filed: Aug. 19, 1991

[30] Foreign Application Priority Data

Aug. 20, 1990 [JP] Japan ..... 2-218364

[51] Int. Cl.[5] ..... G05F 3/28

[52] U.S. Cl. ..... 323/314; 307/296.7; 330/257; 330/260

[58] Field of Search ..... 323/312, 313, 314, 315, 323/316; 307/296.1, 296.6, 296.7; 330/257, 260, 288, 297

[56] References Cited

U.S. PATENT DOCUMENTS

| | | | |
|---|---|---|---|
| Re. 30,586 | 4/1981 | Brokaw | 323/314 |
| 4,087,758 | 5/1978 | Hareyama | 330/260 |
| 4,287,439 | 9/1981 | Leuschner | 307/310 |
| 4,713,600 | 12/1987 | Tsugaru et al. | 323/314 |
| 4,795,961 | 1/1989 | Neidorff | 323/314 |

FOREIGN PATENT DOCUMENTS 0329247 8/1989 European Pat. Off. .

OTHER PUBLICATIONS

Wrathall, R. S., "Session XI: Operational Amplifiers and Voltage Regulators", *IEEE International Solid-State Circuits Conference*, vol. 28, pp. 144-145 (Feb. 1985, Coral Gables, Fla.

Kash, R., "Analog MOS on Semi-Custom Integrated Circuits", *Wescon Conference Record*, vol. 24, pp. 1-6, (Sep. 1980, Anaheim, Calif.).

Ware et al., "A 200-MHz CMOS Phase-Locked Loop with Dual Phase Detectors", *IEEE Journal of Solid-State Circuits*, vol. 24, No. 6, pp. 1560-1568 (Dec. 1989, N.Y.).

"A Simple Three-Terminal IC Bandgap Reference," Paul A. Brokaw, *IEEE Journal of Solid State Circuits*, vol. SC-9, No. 6 pp. 388-393, Dec. 1974.

*Primary Examiner*—Peter S. Wong

*Attorney, Agent, or Firm*—Edward D. Manzo

[57] ABSTRACT

The circuit-voltage generation circuit according to the present invention incorporates a reference voltage generation circuit employing a first and a second transistors which output a first and a second reference voltages based on a bandgap voltage and controlling a current flow from a power source in response to a standard output voltage, a first level shift circuit generating a third reference voltage based on the first reference voltage, a second level shift circuit generating a fourth reference voltage based on the second reference voltage, and a standard voltage generation circuit which inputs the third and the fourth reference voltages respectively to the first and the second input terminals and amplifies the difference voltage between the third and the fourth reference voltages so as to output the standard output voltage.

11 Claims, 2 Drawing Sheets

CONSTANT-VOLTAGE GENERATION CIRCUIT

REFERENCE TO RELATED APPLICATIONS

This application claims the right of priority under 35 U.S.C. 119, of Japanese Patent Application Serial No. 02-218364, filed on Aug. 20, 1990.

BACKGROUND OF THE INVENTION

1. Field of the Invention

The present invention relates to a constant-voltage generation circuit which is manufactured in a standard CMOS process technology; a standard output voltage of which is determined by a bandgap voltage of transistors, and more particularly to a constant-voltage generation circuit employing operational amplifiers operated by a single power source.

2. Description of the Related Art

A constant-voltage generation circuit preserves its standard output voltage at a constant level, though the inputted voltage varies due to temperature variation.

A conventional constant-voltage generation circuit is well known, for example, disclosed in Japanese Patent Laid-Open Publication NO. 61-217815.

The conventional circuit includes a reference voltage generation circuit and amplifiers, in which the reference voltage generation circuit is connected to power source voltage $V_{DD}$ and outputs reference voltages V1 and V2 by inputting standard output voltage VR of the output of the circuit.

The operational amplifiers output standard output voltage VR by differentially amplifying reference voltages V1 and V2.

The reference voltage generation circuit, which incorporates two transistors operationally controlled by standard output voltage VR and a plurality of resistors, outputs reference voltages V1 and V2 based upon the bandgap voltage of these transistors.

Two transistors and the plurality of resistors of the reference voltage generation circuit are connected to each other in such a manner that a reference voltage satisfying $V1<Vs$ or $V1>V2$ is outputted, respectively, depending on standard voltage VR being either higher or lower.

The operational amplifiers are so constructed that the non-inverted input terminal is connected to reference voltage V1 and the inverted input terminal is connected to reference voltage V2, respectively.

The operational amplifier outputs at its output terminal standard voltage VR which is amplified in proportion to the voltage between the two input terminals.

It is well known as such the operational amplifiers include constituted either a combination of a PNP-MOS transistor and an NPN-MOS transistor or an NPN-MOS transistor and a PNP-MOS transistor.

In both cases, the operational amplifiers are connected between power source voltage $V_{DD}$ and negative power source voltage $V_{SS}$, in which the prescribed transistors differentially amplify reference voltages V1 and V2.

In the above described constant-voltage generation circuit, when standard output voltage VR increases as a result of a change temperature, reference voltage V1 becomes lower than reference voltage V2, whereby the supply voltage to the non-inverted terminal of the operational amplifier becomes lower than the voltage supplied to the inverted input terminal so that standard output voltage VR drops.

In this manner, the constant-voltage generation circuit compensates standard output voltage VR so as to output stabilized constant standard output voltage VR.

The constant-voltage generation circuit according to the conventional technology has the following problems set forth below to be improved.

The requirement for low power consumption restricts two transistors in the reference voltage generation circuit to be supplied with high current.

Also, the requirement for minimizing package area restricted the resistor employed in the reference voltage generation circuit to a large resistance value.

As the result, the reference voltage is set to nearly ground voltage GND.

Accordingly, since reference voltages V1 and V2 become less than a threshold voltage of the differential amplification transistor of the operational amplifier, the transistor turns off occasionally.

In order to preserve the threshold voltage of the transistor, negative power supply voltage $V_{SS}$ of the operational amplifier must be set lower than ground voltage GND.

For the reasons set forth above, the conventional constant-voltage generation circuit requires another negative power supply voltage $V_{SS}$ in addition to normal power supply voltage $V_{DD}$ and ground voltage GND.

SUMMARY OF THE INVENTION

An object of the present invention is to provide an improved constant-voltage generation circuit which can be operated with a single power supply.

To accomplish the object, the present invention provides a constant-voltage generation circuit for preserving an output voltage at a constant voltage level which has a reference voltage circuit coupled to a power source for outputting a first and a second reference voltages in response to a standard output voltage; a first level shift circuit for outputting a third reference voltage in response to the first reference voltage; a second level shift circuit for outputting a fourth reference voltage in response to the second reference voltage; and a standard voltage generation circuit for outputting the standard output voltage by amplifying a differential voltage between the third reference voltage and the fourth reference voltage.

Further scope of applicability of the present invention will become apparent from the detailed description and specific examples, while indicated as preferred embodiments of the invention, are given by way of illustration only, since various changes and modifications within the spirit and scope of the invention will become apparent to those skilled in the art from this detailed description.

BRIEF DESCRIPTION OF DRAWINGS

These and other features and advantages of the invention may be more completely understood from the following detailed description of the preferred embodiments of the invention with reference to the accompanying drawings in FIG. 1 is a circuit diagram of a constant-voltage generation circuit illustrating one embodiment of the present invention.

DETAILED DESCRIPTION OF THE PREFERRED EMBODIMENTS

Referring to the attached drawings, the preferred embodiments according to the present invention will be further explained in detail.

Figure 1:
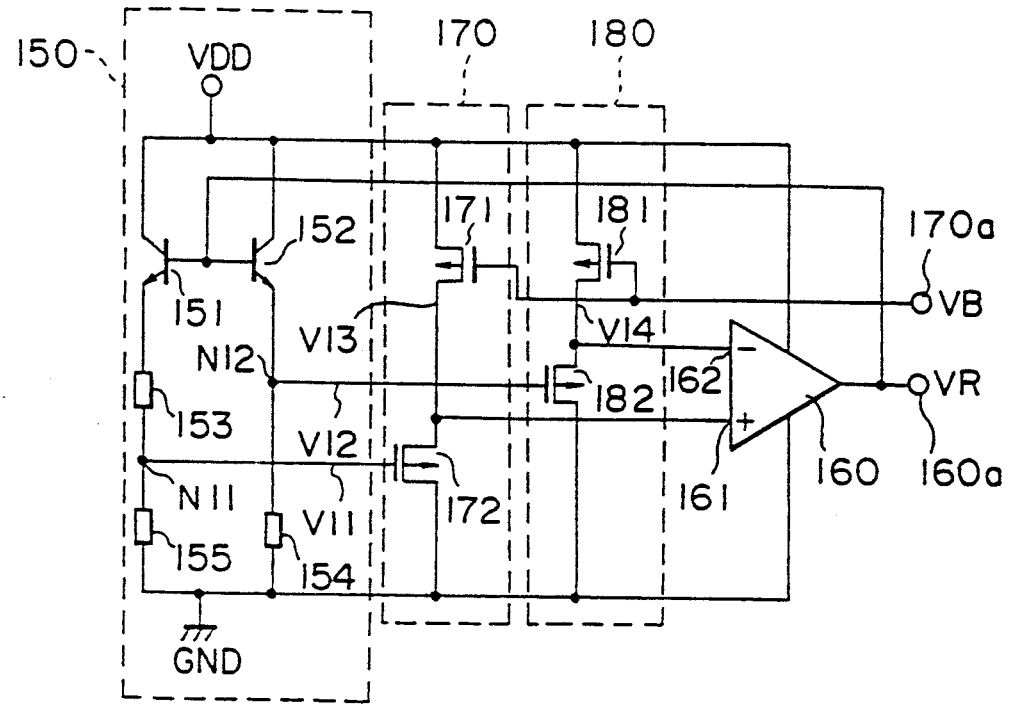

FIG. 1 shows a circuit diagram of a constant-voltage generation circuit illustrating one embodiment of the present invention, which comprises reference voltage generation circuit 150, standard output voltage generation circuit (operational amplifier) 160, first level shift circuit 170 and second level shift circuit 180.

Reference voltage generation circuit 150 outputs first and second reference voltages V11 and V12 based on the bandgap voltages of the first and the second transistors which control, in response to standard output voltage VR outputted from standard output voltage generation circuit 160, the current from power source voltage $V_{DD}$.

First level shift circuit 170 elevates first reference voltage V11 to a prescribed level (the third reference voltage) depending on the value of second reference voltage V11.

Second level shift circuit 180 elevates second reference voltage V12 to a prescribed level (the fourth reference voltage) depending on the value of second reference voltage V12.

Standard output voltage generation circuit 160 amplifies the difference voltage between the third and the fourth reference voltages to output standard output voltage VR as the output of the constant-voltage generation circuit.

Standard output voltage VR is also outputted to reference voltage generation circuit 150 to supply negative feed-back to reference voltage generation circuit 150.

Reference voltage generation circuit 150 incorporates NPN type first transistor 151, the collector and the emitter of which are respectively connected to power source voltage $V_{DD}$ and resistor 153, and the base of which is connected to the base of NPN type second transistor 152.

The collector and the emitter of transistor 152 are respectively connected to power source $V_{DD}$ and node N12 where second reference voltage appears.

Node N12 is connected via resistor 154 to ground voltage GND.

Resistor 153 is also connected to ground voltage GND via node N11 and resistor 155 where first reference voltage appears at node N11.

Transistors 151 and 152 differ from each other in emitter size.

First level shift circuit 170 comprises PMOS transistor 171 operating as a constant-current circuit for the first level shift and PMOS transistor 172 operating as a driving transistor for the first level shift.

The source, drain and gate of PMOS transistor 171 are respectively connected to power source voltage $V_{DD}$, the source of PMOS transistor 172 and input terminal 170*a* which is used for inputting external bias voltage VB.

The drain and the gate of PMOS transistor 172 are respectively connected to ground voltage GND and node N11.

Second level shift circuit 180 comprises PMOS transistor 181 operating as a constant-current circuit for the second level shift and PMOS transistor 184 operating as a driving transistor for the second level shift.

The source, the drain and the gate of transistor 181 are respectively connected to power source $V_{DD}$, the source of PMOS transistor 184 and input terminal 170*a* which is used for inputting external bias voltage VB.

The drain and the gate of PMOS transistor 184 are respectively connected to ground voltage GND and node N12.

Further, the source of PMOS transistor 172 is connected to non-inverted input terminal (first input terminal) 161 of the operational amplifier constituting the standard output voltage generation circuit 160.

The source of PMOS transistor 184 is connected to inverted input terminal (second input terminal) 162 of the operational amplifier.

Input terminals 161 and 162 of the operational amplifier are respectively inputted third reference voltage V13 and fourth reference voltage V14.

The output of the operational amplifier VR is connected to the bases of transistor 151 and 152 and to output terminal 160*a* where standard output voltage VR is outputted.

Both PMOS transistors 171 and 181 are the same size. Also, both PMOS transistors 172 and 184 are the same size.

Figure 2:
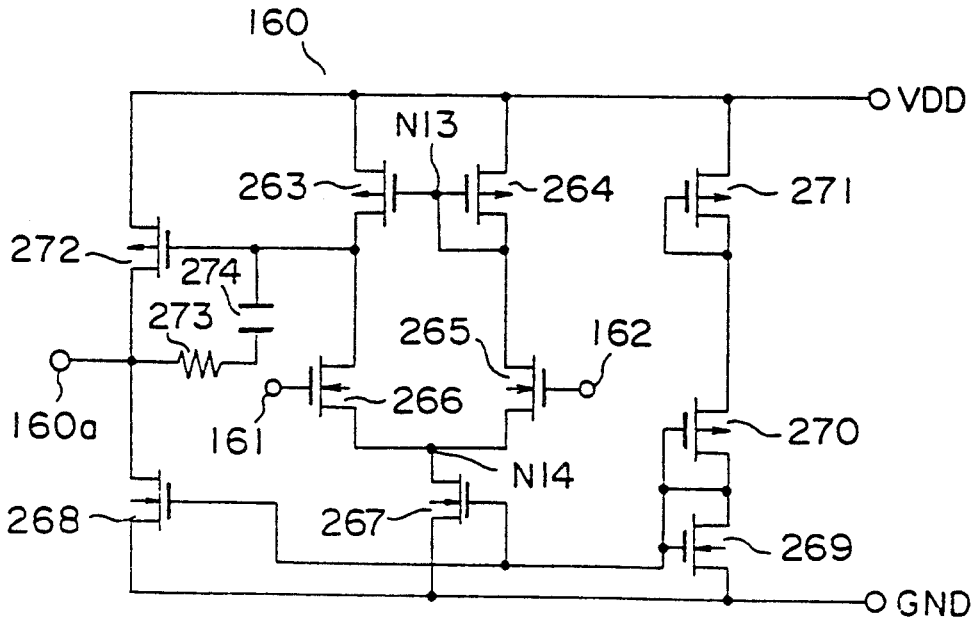
FIG. 2 is a circuit diagram of illustrating one embodiment of the operational amplifier shown in FIG. 1.

FIG. 2 is a circuit diagram of the operational amplifier constituting the standard output voltage generation circuit 160 shown in FIG. 1 which illustrates embodiment of the present invention.

The operational amplifier incorporates PMOS transistors 263 and 264, the sources of each are respectively connected to power source voltage $V_{DD}$.

The gate of PMOS transistor 263 is connected to the gate of PMOS transistor 264 at connecting node N13 where the drains of transistor 264 and NMOS transistor 265 are respectively connected.

The drain of transistor 263 is connect to the drain of NMOS transistor 266, and the source of the transistor 266 is connected to the source of NMOS transistor 265 at connecting node N14.

The gate of transistor 266 is connected to non-inverted input terminal 161.

The gate of transistor 265 is connected to inverted input terminal 162.

The drain and the gate of NMOS transistor 267 are respectively connected to connecting node N14 and each of gates of NMOS transistors 268 and 269.

Further, each of sources of transistors 267, 268 and 269 is respectively connected to ground voltage GND.

The gate and the drain of PMOS transistor 270 are commonly connected each other and further connected to the gate and drain of transistor 269.

The gate and the drain of PMOS transistor 271 are also commonly connected each other and further connected to the source of transistor 270.

The source and the gate of PMOS transistor 272 are respectively connected to power source voltage $V_{DD}$ and the drains of transistor 263 and 266.

Both of the drains of transistors 263 and 266 are connected, via phase compensation resistor 273 and capacitor 274, to the drains of transistors 268 and 272.

The drains of transistors 272 and 268, which are commonly connected and constitute an output terminal of the standard output voltage generation circuit 160, are connected to output terminal 160*a* where the output of the constant-voltage generation circuit according to the invention is achieved.

Now, hereinafter, the operations of the constant-voltage generation circuit described above will be further explained.

The standard output voltage of the constant-voltage generation circuit is determined by the bandgap voltage of transistors.

Accordingly, first and second reference voltages V11 and V12 become low, nearly equal to ground voltage GND, so that PMOS transistors 172 and 184 turn "on".

When bias voltage VB is, on this instance, provided at input terminal 170*a*, the prescribed current passes, via PMOS transistor 172, from power source voltage $V_{DD}$ to ground voltage GND, respectively, because PMOS transistors 171 and 181 stay "on".

On this instance, due the "on" state of PMOS transistor 172, third reference voltage V13 appears at the source of transistor 172 and is also provided to none-inverted input terminal 161.

In the same way, due the "on" state of PMOS transistor 184, fourth reference voltage V14 appears at the source of PMOS transistor 184 and is also provided to inverted input terminal 162.

Third and fourth reference voltages V13 and V14 are respectively elevated approximately to half level of power source voltage $V_{DD}$.

Accordingly, there is no need to prepare other power source ($V_{SS}$) to be connected to the operational amplifier.

In this invention, when ground voltage GND is connected to transistor 267 for supplying constant-current, transistors 265 and 266 can operate stably, whereby standard output voltage VR can be achieved from output terminal 160*a*.

When standard output voltage VR elevates due to, for example, variation of temperature, the current passing between collectors and emitters of transistor 151 and 152 varies in accordance with the elevated value of standard output voltage VR.

As the result, first reference voltage V11 which is lower than second reference voltage V12 and is also determined by a differential ratio of resistors 153 and 155 will appear at node 11.

Accordingly, the conductivity of PMOS transistor 172 is greater than that of PMOS transistor 184, whereby third reference voltage V13 appears at the source of PMOS transistor 172 depending on the value of first reference voltage V11.

In the same manner, the fourth reference voltage V14 appears at the source of transistor 184 depending on the value of second reference voltage V12.

On this instance, third reference voltage V13 becomes lower than fourth reference voltage 14.

As the result, the gate voltage of transistor 265 becomes higher than the gate voltage of transistor 266 so that the gate voltage of transistor 172 elevates, which causes drop of standard output voltage VR at output terminal 160*a*.

In this manner, stabilized standard output voltage VR with constant voltage level can be outputted.

Figure 3:
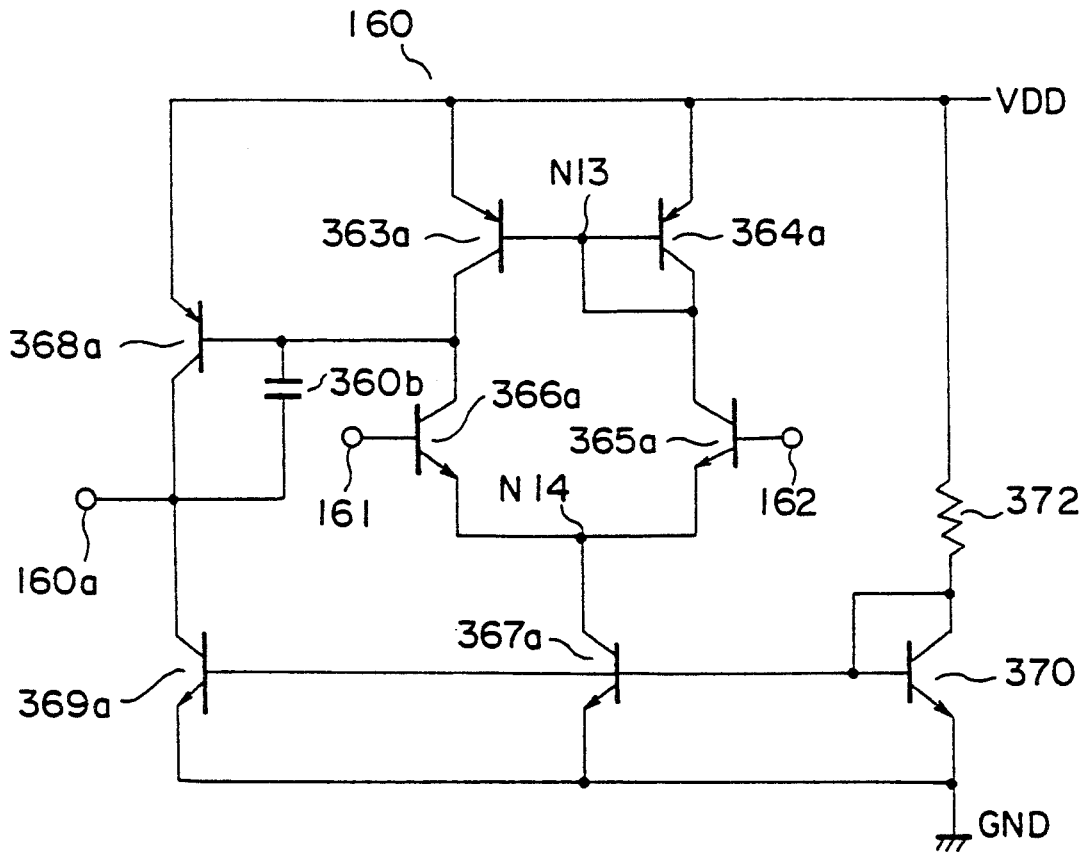
FIG. 3 is a circuit diagram illustrating another embodiment of the operational amplifier shown in FIG. 1.

FIG. 3 is a circuit diagram of the operational amplifier employed in the constant-voltage generation circuit illustrating another embodiment of the present invention.

This constant-voltage generation circuit substitutes bipolar transistors for operational amplifier 160 shown in FIG. 1 and the circuit design, which the is nearly same as in FIG. 2, comprises a differential amplifier stage including a PNP transistors 363*a* and 364*a*, and NPN transistors 365*a*, 366*a* and 367*a*, an output stage constituted by PNP transistor 368*a* and NPN transistor 369*a*, phase compensation capacitor 360*b* for the output stage, and an internal bias circuit stage constituted by NPN transistor 370 and resistor 372.

The present invention is not limited to the forgoing embodiments illustrated since various changes and modifications can be achieved within the spirit and scope of the invention.

For example, instead of PMOS transistors 171 and 181 utilized as the constant-current circuit for the first level shift circuit, resistors can be alternatively utilized.

As explained above in detail, the present invention is designed such that the first driving transistor for level shift and the first constant-current power source for level shift the first reference voltage, and the second driving transistor for level shift and the second constant-current power source for level shift the second reference voltage, whereby other power source can be eliminated except for the power source which operates the standard output voltage generation circuit.

In other words, a constant-voltage generation circuit can be realized with a single power source.

We claim:

1. A constant-voltage generation circuit for outputting an output voltage signal comprising:

a) a reference voltage circuit coupled to a power source for outputting first and second reference voltage signals in response to the output voltage signal;

b) a first level shift circuit for outputting a third reference voltage signal in response to the first reference voltage signal;

c) a second level shift circuit for outputting a fourth reference voltage signal in response to the second reference voltage signal; and d) a standard voltage generation circuit for outputting the output voltage signal by amplifying a differential voltage between a voltage level of the third reference voltage signal and a voltage level of the fourth reference voltage signal.

2. The constant-voltage generation circuit in accordance with claim 1 wherein said reference voltage circuit comprises: first and second bipolar each transistors having a respective base, collector and emitter;

wherein the collectors of said first and second bipolar transistor are connected to the power source;

wherein the bases of said first and second bipolar transistors are commonly connected to each other and the output voltage signal being provided thereto;

first, second and third resistors;

wherein the emitter of said first bipolar transistor is connected to one end of said first resistor;

wherein the other end of said first resistor is connected to one end of said second resistor;

wherein the other end of said second resistor is connected to one end of said third resistor;

wherein the other end of said third resistor is connected to the emitter of said second bipolar transistor; and whereby the first reference voltage signal appears at one end of said second resistor, and the second reference voltage signal appears at the other end of the third resistor.

3. The constant-voltage generation circuit in accordance with claim 1 wherein the first level shift circuit comprises a first constant-current source and a first level shift driving circuit connected to each other in series, whereby the third reference voltage signal is generated between the first level shift driving circuit and the first constant-current source when the first reference voltage signal is inputted to the first level shift driving circuit.

4. The constant-voltage generation circuit in accordance with claim 3 wherein the first constant-current source and the first level shift driving circuit include PMOS transistors.

5. The constant-voltage generation circuit in accordance with claim 4 wherein the PMOS transistor of the first constant-current source is controlled at its base by an external bias voltage signal.

6. The constant-voltage generation circuit in accordance with claim 4 wherein the second level shift circuit comprises a second constant-current source and a second level shift driving circuit connected to each other in series, the second constant current source circuit includes a PMOS transistor, and wherein the PMOS transistors of the first and second constant-current sources are controlled at the base by an external bias voltage signal, and have the same input-output characteristics.

7. The constant-voltage generation circuit in accordance with claim 1 wherein the second level shift circuit comprises a second constant-current source and a second level shift driving circuit connected each other in series, whereby the fourth reference voltage signal is generated between the second level shift driving circuit and the second constant-current source when the second reference voltage signal is inputted to the second level shift driving circuit.

8. The constant-voltage generation circuit in accordance with claim 7 wherein the second constant-current source and the second level shift driving circuit include PMOS transistors.

9. The constant-voltage generation circuit in accordance with claim 1 wherein the PMOS transistor of the second constant-current source is controlled at its base by an external bias voltage source.

10. The constant-voltage generation circuit in accordance with claim 1 wherein the standard voltage generation circuit includes an operational amplifier.

11. A constant voltage generation circuit for outputting an output voltage signal comprising:

a) reference voltage circuit coupled to a power source for outputting a first signal having a first voltage level and a second signal having a second voltage level in response to the output voltage signal;

b) a first level shift circuit for outputting a third signal having a third voltage level in response to the first signal;

c) a second level shift circuit for outputting a fourth signal having a fourth voltage level in response to the second signal;

d) an output voltage generation circuit for outputting the output voltage signal obtained by amplifying a differential voltage between the third signal and the fourth signal.

* * * * *